United States Patent [19]

Helle et al.

[11] 4,098,654

[45] Jul. 4, 1978

[54] CODEPOSITION OF A METAL AND FLUOROCARBON RESIN PARTICLES

[75] Inventors: Kees Helle, Bennekom; Robert Cornelis Groot, Rheden (G.); Andries Kamp, Zevenaar, all of Netherlands

[73] Assignee: Akzo N.V., Arnhem, Netherlands

[21] Appl. No.: 728,227

[22] Filed: Sep. 30, 1976

[30] Foreign Application Priority Data

Oct. 4, 1975 [NL] Netherlands ..... 7511699
Apr. 26, 1976 [NL] Netherlands ..... 7604398

[51] Int. Cl.[2] ..... C25D 15/00; C25D 15/02

[52] U.S. Cl. ..... 204/16; 204/181 C; 204/DIG. 2

[58] Field of Search ..... 204/16, DIG. 2, 181

[56] References Cited

U.S. PATENT DOCUMENTS

| | | | |
|---|---|---|---|
| 2,559,752 | 7/1951 | Berry | 260/29.6 |
| 2,820,752 | 1/1958 | Heller | 204/181 |
| 3,677,907 | 7/1972 | Brown et al. | 204/16 |
| 3,787,294 | 1/1974 | Kurosaki et al. | 204/16 |

FOREIGN PATENT DOCUMENTS

| | | |
|---|---|---|
| 1,355,601 | 6/1974 | United Kingdom. |
| 1,366,823 | 9/1974 | United Kingdom. |

OTHER PUBLICATIONS

Tenside Detergents, vol. 13, 1976, pp. 1–5.

*Primary Examiner*—T. M. Tufariello
*Attorney, Agent, or Firm*—Stevens, Davis, Miller & Mosher

[57] ABSTRACT

Polyfluorocarbon resin particles and metals are codeposition from electroplating baths to form coating layers of a very homogeneous structure, when said positively charged resin particles having a particle size of less than about 10 μm are kept dispersed in said baths in the presence of both a cationic and a nonionic fluorocarbon surfactant in a molar ratio between 25:1 and 1:3.5 and in a total amount of at least $3 \times 10^{-3}$ millimoles per m2 of surface area of said particles.

19 Claims, 4 Drawing Figures

CODEPOSITION OF A METAL AND FLUOROCARBON RESIN PARTICLES

Figure 1:
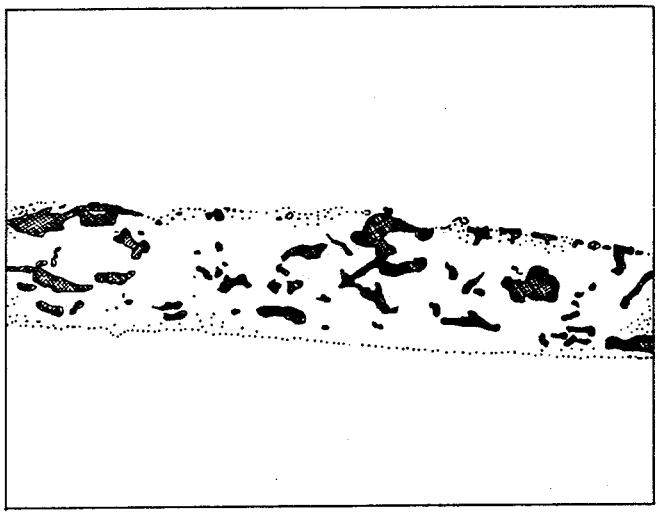

This invention relates to the cathodic codeposition of metals and fine particles of fluorocarbon or modified fluorocarbon resins dispersed as fine positively charged powders in aqueous electroplating baths containing dissolved therein effective amounts of cationic and nonionic fluorocarbon surface-active agents.

It relates especially to the codeposition of these fluorocarbon resin particles with nickel, cobalt, iron and their binary and ternary alloys, and with copper, silver, gold, brass, lead, and lead-tin and lead-tin-copper alloys from the respective metal plating baths containing dissolved therein both a cationic and a nonionic fluorocarbon surfactant.

Netherlands Patent Specification No. 7,203,718 describes a process for the codepositing from an electroplating bath of a composite coating made up of a polyfluorocarbon resin and a metal, and, if desired, particles of a different material on an electrically conductive substrate acting as a cathode, which resinous particles have an average particle size of less than about 10 μm and are kept dispersed in a concentration of about 3 to 150 grammes per litre of bath solution in the presence of a cationic fluorocarbon surfactant and a nonionic surfactant.

The above described process had the disadvantage that after some time the particles dispersed in the electroplating bath tend to flocculate. Although this phenomenon can be remedied somewhat by continuous agitation of the bath, it will yet be necessary after some time to re-disperse the particles. This disadvantage will be even more manifest if the bath is used at long intervals.

Such a situation will be encountered for instance in electroplating plants were the metal component to be deposited is continually varied, so that a large number of different baths must constantly be kept ready for use.

Another disadvantage of the above described process is the structure of the coatings obtained. Although to the eye this structure seems very homogeneous, microscopic examination reveals that the majority of the polyfluorocarbon particles is present in the form of agglomerates. As a result, the structure of the known coatings still shows so many irregularities that under some circumstances the coatings are too readily damaged.

It is an object of this invention to provide a process by which the drawbacks to the known process are largely removed.

Another object of the invention is to provide composite coatings thus deposited. According to a still further aspect of the present invention, there are provided plated products which are entirely or partly provided with a coating thus deposited.

The foregoing objects and others are accomplished in accordance with the invention if in a process of the type indicated above as known there is provided for the following measures:

(a) using for the nonionic surface active compound a fluorocarbon compound;

(b) maintaining the molar ratio between the cationic surface active fluorocarbon compound and the nonionic surface active fluorocarbon compound between 25:1 and 1:3.5 and (c) maintaining the total amount of the surface active fluorocarbon compounds above $3 \times 10^{-3}$ mmoles per ml of surface area of the polyfluorocarbon resinous particles.

For the determination of the surface area of the particles use may with advantage be made of the nitrogen adsorption method of Brunauer, Emmett and Teller (BET) standardized in the German Industrial Standard Method DIN 66 132.

The use of a nonionic fluorocarbon surfactant in the depositing from an electroplating bath of a metal coating containing a polyfluorocarbon compound is disclosed in U.S. Pat. No. 3,787,294. In said specification it is stated, however, that under the conditions of the electrolysis this nonionic fluorocarbon compound must show cationic properties. No mention is made at all of the possible advantages of the combination of a cationic surface active compound and a nonionic surface active compound.

Moreover, the amounts of wetting agent used per gramme of polymer in the examples are absolutely insufficient to obtain a reasonably stable dispersion.

It will be clear that a stable dispersion is a prerequisite in electrolytically depositing a metalcoating containing finely divided resinous particles.

Also in U.S. Pat. No. 3,677,907 (to H. Brown et al.) mention is made in an enumeration of a great number of fluorocarbon surfactants of one compound of the nonionic type. But the wetting agents used in the examples are all of the anionic type.

For the use of a mixture of fluorocarbon surfactants of both the cationic and the nonionic type no suggestions are made in it at all, let alone for the proportions in accordance with the present invention. Said patent specification does mention that favourable results may be obtained by the side-by-side use of various types of surface active compounds. But then only the use is meant of a surface active fluorocarbon compound in combination with a surface active compound of the usual hydrocarbon type.

The object of the use of the last-mentioned compound is that from the bath organic impurities such as dust, traces of coating material etc. are taken up in micelles and thus masked. Use is made of such a combination also in the above-mentioned Netherlands Patent Specification No. 7,203,718.

The metal coatings according to the invention can be applied in all cases which allow of the electroplating of a metal alone.

As examples of metals may be mentioned here: silver, iron, lead, cobalt, gold, copper, zinc, metallic alloys such as bronze, brass and the like and more particularly nickel.

The most favourable results are found to be obtained if the process according to the invention is so carried out that the total amount of fluorocarbon surfactants is within the range of from $6.10^{-3}$ to $12.10^{-3}$ mmoles per m2 of surface area of the particles. As this last mentioned range makes it possible for the stability of the electroplating baths to be exceptionally high, it is of particular advantage for industrial applications. Stirring will in fact only be necessary to prevent the concentration on the cathode from decreasing during the electrolysis.

The use of more than $12.10^{-3}$ mmoles of surface active fluorocarbon compounds per m2 of polyfluorocarbon resinous particles will not generally lead to any additional advantage.

For instance, in the case where the metal which is codeposited along with polyfluorocarbon compounds is nickel, the use of an excess of wetting agent will cause the coating to be brittle and unsuitable for most applications. Moreover, the cost aspect will play a role then.

For the price of the fluorocarbon surfactants per unit of weight is a multiple of that of the polyfluorocarbon resinous particles to be included.

The proportion of nonionic surfactants should be strictly within the limits indicated. If the cationic and the nonionic surfactants are used in a molar ratio higher than 25:1, then the quality of the coatings will quickly drop to the level at which agglomeration occurs.

Agglomeration will also take place at a molar ratio smaller than 1:3.5, as a result of which and because of a smaller charge on the particles, the extent to which they are included is very much reduced.

It should be added that said proportion exclusively holds for surface active fluorocarbon compounds. For in some cases it may be of advantage also to add to the electrolysis bath a nonionic surface active compound which does not contain fluorine in order that organic impurities which do not or hardly contain any fluorine may be taken up in micelles and thus be masked.

To this end use may be made of the condensation products of octyl phenol and ethylene oxide (marketed by Rohm & Haas under the trade name "Triton X-100"), of nonyl phenol and ethylene oxide (known under the trade names NOP 9 and Kyolox NO 90 and marketed by Servo and Akzo Chemie, respectively) and of lauryl alcohol and ethylene oxide. The amounts to be used thereof very much depend on the organic impurities contained in the electroplating bath. For a man skilled in the art it will not be difficult to choose for each particular case the most favourable amount, which is generally within the range of from 0.005 to 1 percent by weight of the bath liquid.

The percentage polyfluorocarbon resinous particles that can be incorporated into the composite coating when use is made of the process according to the invention ranges from a few percent by volume to not more than about 73% by volume. The number of particles that will be deposited from each liter of bath liquid will increase with decreasing particle size.

It will not be difficult for a man skilled in the art to choose the proper conditions for obtaining the desired percentage by volume of polyfluorocarbon particles.

In some case it may be desirable that besides the polyfluorocarbon resinous particles there are incorporated into the metal coating according to the invention particles of other polymers or inorganic materials such as diamond, carborundum, $Al_2O_3$,$SiO_2$, pigments etc. In such cases advantage may be derived from the further addition of a surface active cationic compound which does not contain fluorine in combination or not with a nonionic compound of the same type. For the amounts to be used thereof the same criteria may be used as indicated above for the fluorocarbon compounds. The molar ratio nonionic to cationic, however, is far less critical here. The same may be said for the total amounts to be employed.

In carrying out the process according to the invention it has been found that always very good results are obtained if the molar amount of nonionic surface active fluorocarbon compounds is about 17 to 36 percent of the total molar amount of surface active fluorocarbon compounds used for the dispersion of the particles. Optimum results will generally be obtained if the molar amount of nonionic fluorocarbon compounds is about 26 percent of the total molar amount of surface active fluorocarbon compounds used for the dispersion of the particles.

By cationic surface fluorocarbon compounds are to be understood here all simple or composite surface active compounds having fluorine-carbon bonds (C-F bonds) and being capable of imparting a positive charge to the fluorocarbon resin particles in the electroplating bath.

It is preferred that use should be made of perfluorinated compounds having a quaternary ammonium group. Suitable cationic surface active compounds of the simple type are those that are described in British Patent Specification No. 1,424,617.

In this connection reference may be made also to the following cationic fluorocarbon compounds, which are derived from fluorocarbon anionic wetting agents having the general formula $CF_3$-$(CF_2)_n$ COOH or $CF_3$ $(CF_2)_n$ $SO_3H$ where $n$ = 4–18. After esterification with a lower alcohol compound with the formula $CF_3(CF_2)_n$-COOH may first be created with ammonia to form the amide and subsequently converted into the respective amine by the Hofman reaction.

The amine may in its turn easily be converted into a cationic wetting agent, such as a tetra-alkyl ammonium salt, for instance by exhaustive alkylation, or into a hydrochloric acid salt by reaction with hydrochloric acid.

Another more general method of converting anionic wetting agents into their cationic counterparts comprises reacting an alkyl diamine such as ethylene diamine or a compound of the type

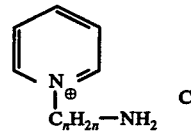

wherein n = 1 to 4, with the respective anionic wetting agent.

A suitable cationic wetting agent may be a fluorocarbon compound of the general formula.

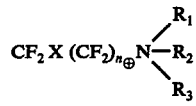

Y $\theta$ wherein X is a hydrogen atom or a halogen atom, $R_1$, $R_2$ and $R_3$ are alkyl groups having not more than 4 carbon atoms, Y is a halogen atom, and n represents an integer from 2 to 8.

Composite surface active compounds of the fluorocarbon type are preferably prepared in situ by pouring a negatively charged dispersion of fluorocarbon resin particles wetted with an anionic surface active fluorocarbon compound in a gently stirred aqueous solution of a cationic surface active compound. This compound need not be of the fluorocarbon type. It should be present in a molar excess relative to the anionic compound used for the dispersion of the fluorocarbon particles. It is preferred to use a molar ratio higher than 3. Examples of cationic dispersions of fluorocarbon resin particles thus prepared are described in for instance the British Patent Specification No. 1,388,479. Other examples of suitable surface active cationic fluorocarbon compounds of the simple type are:

1)

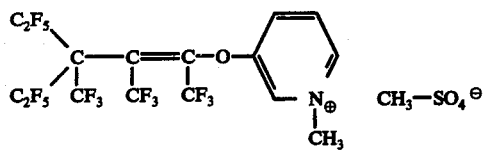

which is marketed by ICI under the trade name Monflor 71

2)

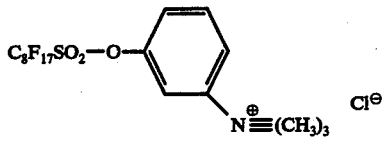

3)

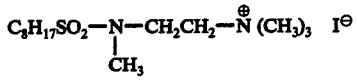

4)

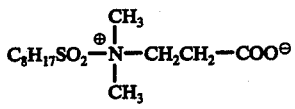

The compound under 4 is in fact amphoteric, but has cationic properties under the conditions prevailing in most electroplating baths.

Of the above mentioned compounds the wetting agents which have a straight fluorocarbon chain, have been found to give the best results. It has moreover been found that the presence of reducible sulphur, as in the compounds mentioned under 2, 3 and 4, also may favourably influence the quality of the coatings. Also the presence of other stress reducing groups, such as a phenyl group, may lead to an increase in ductility of the coating.

In view of the risk of electrochemical oxidation it is sometimes preferred that the anion of the compound given under 3 should be replaced with a $Cl^{\ominus}$ or $SO_4^{2-}$-ion.

Under some circumstances it may be desirable to add to the electroplating bath a stress reducing agent such as p-toluene sulphonamide or saccharin.

The nonionic surface active fluorocarbon compounds used in the process according to the invention are as a rule perfluorinated polyoxyethylene compounds.

Here too it has been found that the presence of a sulphur-containing group may favourably influence the quality of the coatings.

A suitable commercially available surface active fluorocarbon compound with nonionic properties is marketed by ICI under the trade name Monflor 52.

This compound is characterized by the following structural formula:

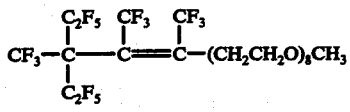

A disadvantage of this compound is the non-linear fluorocarbon chain, as a result of which it will less readily adjoin the polyfluorocarbon resin particles. Another practical drawback consists in the polyfluorocarbon particles turning yellow upon the passing through of electric current.

To remove this drawback the invention provides a process in which as nonionic fluorocarbon - containing wetting agent there is used a compound having the following structural formula:

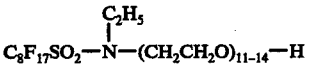

where $C_8F_{17}$ represents a straight chain. The last mentioned wetting agent is marketed by Minnesota Mining & Manufacturing Company under the trade name FC 170. Other examples of nonionic surface active fluorocarbon compounds that may be used in the process according to the invention are:

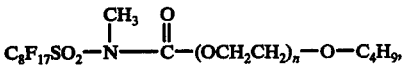

where n = 3 to 20 and on an average about 6, and

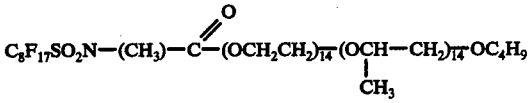

The number of the ethylene oxide groups of the nonionic surface active fluorocarbon compounds which may with advantage be used according to the invention is at least 2 and as a rule not more than 18.

The hydrophilic properties of the nonionic surface active fluorocarbon compounds may, of course, also be obtained by using groups other than those derived from ethylene oxide. As example may be mentioned a group derived from polyglycerol. As examples of polyfluorocarbon resins that may with advantage be used in the process according to the invention may be mentioned polytetrafluoroethylene, polyhexafluoropropylene, polychlorotrifluoroethylene, polyvinylidene fluoride, tetrafluoroethylenehexafluoropropylene copolymer, vinylidenefluoride-hexafluopropylene copolymer, fluorsilicon elastomers, polyfluoroaniline, tetrafluoroethylene-trifluoronitrosomethane copolymer and graphite fluoride.

Off all these compounds the properties may be varied by incorporating substances such as pigments, colourants, soluble chemical compounds, compounds with capped or non-capped reactive terminal groups, inhibitors and dispersion agents.

The diameter of the resinous particles does not usually exceed 10 μm and the thickness of the coating is mostly in the range of 5 to 125 μm, be it that there may be variations either way.

In order that a most homogeneous coating may be obtained, it is preferred that the particle size should not exceed 5 μm.

Applying a metal coating according to the invention to a light weight metal such as aluminum may for instance comprise the successive steps of first depositing a zinc coating in the known manner and subsequently, while using a low current density and without agitation of the bath, depositing a nickel coating, followed by co-deposition of the combination of nickel and synthetic particles at a considerably higher current density.

Further, it is generally very much recommended that the substrate be subjected to a pre-nickel plating treatment prior to the codeposition of nickel and resinous particles.

In view of its disturbing effect in the electroplating bath containing the resinous particles the presence of iron should be avoided.

In the process according to the invention use may be made of commonly employed electroplating baths, as for instance the sulphamate bath, which makes it possible to attain a high current density, which in its turn leads to a rapid growth of the coating. Moreover, in that case only a relatively low concentration of resinous particles in the bath is needed to obtain a suffiently high resin concentration in the coating. Preference is however given to a Watt's bath.

Not only the composition of the bath but also the temperature at which the electrolysis is carried out plays an important role in obtaining optimum results.

The most favourable temperature is very much dependent on other conditions, but it will not be difficult for a man skilled in the art empirically to establish for a given concentration the temperature at which the most favourable results are obtained.

In the process according to the invention the current density is generally in the range of 1 to 5 A/dm$^2$. Variations either way are possible, however. The percentage by volume of resinous particles to be incorporated into the composite metal coatings is dependent on several variables.

In the case of a P T F E suspension with relatively coarse particles (average particle size 5 $\mu$m, as obtained in suspending in water a powder marketed by Imperial Chemical Industries (ICI) under the trade name Polyflon L 169), the percentage P T F E deposited from a Watt's nickel bath into a coating was found to remain practically constant between a current density in the range of 1 to 5 A/dm$^2$ and a concentration of about 50 g P T F E per liter.

In the case of a P T F E suspension with relatively fine particles (average particle size about 0.3 $\mu$m, as obtained in suspending in water a powder marketed by ICI under the trade name Fluon L 170) it has, also with a concentration of 50 g P T F E/liter, been found that there exists a practically linear relationship between the volume percentage of deposited P T F E and the current density. When use is made of a lower concentration of said last-mentioned fine P T F E powder of, say, 20 g/liter, the percentage of incorporated P T F E is smaller than with a P T F E concentration of 50 g/liter. At a concentration of 20 g/l saturation occurs at a current density as low as 2 A/dm$^2$, above which value the volume percentage of deposited resinous particles does not show any further increase up to a current density of 5 A/dm$^2$. As is the case in the electrolysis of just metals, it may in the process of the present invention be of advantage for the bath liquid to be agitated relative to the cathode for the purpose of avoiding a relatively strong decrease in concentration at the cathode.

If such agitation should become as vigorous as is necessary to avoid agglomeration in the case of the known P T F E suspensions without nonionic surface active fluorocarbon compound, then the volume percentage of deposited P T F E will decrease considerably. Thus it is found that already at a relatively low stirring speed the percentage deposited P T F E will linearly decrease with increasing agitation of the bath liquid relative to the cathode. The quality of the coatings according to the invention differs considerably from the known coatings obtained by the process of the British Patent Specification No. 1,424,617.

Not only does the distribution of the polyfluorocarbon particles in the metal coatings according to the invention differ entirely from the distribution in the coatings known so far, but also the volume percentage of polyfluorocarbon particles that can be deposited is higher. As a result, it is possible now easily to prepare coating compositions which contain up to about 73 per cent by volume of polyfluorocarbon particles.

It is remarkable that coatings having a very high content of polytetrafluoroethylene (PTFE) should yet have a metallic appearance. The structure improvement obtained by using the process according to the invention is clearly illustrated in the appended FIGS. 1 and 2. The two figures give a microscopic enlargement ($\times$ 800) of a cross-section of PTFE-containing metal coating. To facilitate the preparation of a cross-section the two coatings were first provided with a layer of nickel.

It can clearly be seen that the PTFE on the first figure (coating applied by the process of the British Patent Specification No. 1,424,617 is present in the form of agglomerates, whereas the PTFE on the second figure (applied by the process of the present invention) is very uniformly distributed in the coating. As the use of the process according to the invention leads to coatings without pores and cracks, it will be evident that its fields of application is considerably wider than that of the prior art processes. Especially in the case where the coatings may come into contact with agressive liquids, for instance in the case of domestic appliances such as saucepans or industrial equipment such as pipe lines, heat exchangers, etc. the invention will fulfil a great need. In practice it has also been found of advantage for spinneret plates to be provided with a coating according to the invention in that they need less frequently be cleaned then.

In some electroplating plants the metal component to be deposited is continually varied, so that a large number of different baths must constantly be kept ready for use.

Moreover, most electroplating plants are interested in the electrodepositing of coatings with and without polyfluorocarbon resin particles. In that case the number of electroplating baths has to be even twice as high, one series with and one series without polyfluorocarbon resin particles. The number of electroplating baths will be extraordinary high, if also the type of polyfluorocarbon resin particles is varied.

It has further been found that a number of metals, for instance lead, are more difficult to incorporate into a composite coating of the type indicated above.

It is still another object of this invention to provide a process in which the above described drawbacks are largely obviated.

The invention consists in that a process of the aforedescribed type is so carried out that onto an object acting as a cathode there are first codeposited from an electroplating bath a metal and polyfluorocarbon resin particles having an average size of less than about 10 $\mu$m in a concentration of about 3 to 150 grammes per liter of bath liquid in the presence of both a cationic and a nonionic surface active fluorocarbon compound in a molar ratio between 25:1 and 1:3.5 and in an amount which is at least $3 \times 10^{-3}$ mmoles per $m^2$ of surface area of the polyfluorocarbon particles, and that onto the resulting coating serving as cathode there is subsequently deposited from an electroplating bath of a different composition a metal and, if desired, particles of a different material. In the first electrolysis bath used in the process according to the invention a porous layer of polyfluorocarbon particles is found to form on the composite metal coating. This porous layer of polyfluorocarbon particles will continuously increase with the thickness of the composite underlying composite layer of metal and polyfluorocarbon particles. Just as mentioned above with respect to the percentage polyfluorocarbon compounds, the thickness of this porous layer is dependent on the size of the particles and the amount thereof in the bath liquid. Also of importance are temperature, cell voltage, agitation of the bath and the type of metal deposited from the first electrolysis bath. Irrespective of the number of metals to be incorporated into the coating, the process according to the invention may in principle be carried out with the use of only one electroplating bath containing a suspension of polyfluorocarbon particles. For the coating process use may be made of for instance a nickel sulphamate or Watt's nickel bath containing a suspension of polyfluorocarbon particles. If a composite metal coating containing a metal other than nickel is required, then the object to be coated, after a first treatment in a nickel bath containing polyfluorocarbon particles, is placed in an electroplating bath in which a salt of the other metal is dissolved; subsequently, the object is connected to the negative pole and the electrolysis is carried out until the porous and conductive layer formed in the first electrolysis is entirely or partly filled up with the metal used, depending on the required thickness of the composite coating. The part of the porous layer that is not filled up can easily be removed from the object after is has been taken out of the electroplating bath. The process according to the invention makes it possible to produce polyfluorocarbon- and metal - containing coatings in a technologically simple and economically attractive manner.

It will be clear that as far as the number of metals to be incorporated into the coating is concerned the same limitation holds as for the number of metals that can be deposited from the conventional electroplating bath. As examples of suitable metals may be mentioned: silver, iron, lead, nickel, cobalt, gold, copper, zinc, metal alloys such as bronze, brass, etc. The present process also offers great advantages in the case where the two electroplating baths are nickel baths, particularly because of the high speed at which the coating operation can be performed now. In the process according to the invention the second electroplating bath may contain a suspension of a different material such as a resin and/or inorganic particles besides or instead of a metal salt. The charge on the dispersed particles should be positive. The average particle size should certainly not exceed 10 μm and should preferably be smaller. The resins of which the resin particles in the last-mentioned bath are composed may be selected from the class of the polyfluorocarbon compounds or from other polymers such as polyamides, polyesters, polyethers, polyvinyl compounds, latex, polysilicon compounds, polyurethanes and the like. If desired, the resins may contain capped or non-capped reactive groups. The advantages to the process according to the invention, which mainly reside in the high speed at which a composite coating may be produced, come into full play only if the electrolysis bath of a different composition is at least substantially a metal bath.

As examples of suitable inorganic substances that may be deposited from the second electrolysis bath into the porous layer may be mentioned various metals or metal oxides such as those of iron, aluminum, titanium, or chromium, but also particles of molybdenum sulphide, SiC, graphite, graphite fluoride, diamond, carborundum and $SiO_2$.

The positive charge on the above-mentioned particles which do not contain fluorine is generally obtained by the use of a surface active compound which does not contain fluorine in combination or not with a nonionic compound of the same type. For the amounts to be used thereof it is possible in principle to apply the same criteria as indicated above for the fluorocarbon compounds. The molar ratio nonionic to cationic is equal to the above-mentioned ratio for the fluorocarbon compounds. Considering the relatively low cost price of the wetting agents which do not contain fluorine the maximum amount to be used thereof is entirely dependent on the type of electrolysis bath. In general such an amount will be used as is necessary for obtaining a satisfactorily stable dispersion. Larger amounts are as a rule undesirable in that they unfavourably influence the quality of the coating.

Of the non-fluorine-containing surface active cationic compounds particularly the tetra-alkyl ammonium salts are found to give very good results.

In this connection special mention should be made of the trimethyl alkyl ammonium salts, the alkyl group of which contains 10 to 20 carbon atoms. Very good results can be obtained especially with the use of cetyltrimethyl ammonium bromide and hexadecyltrimethyl ammonium bromide. As examples of suitable nonionic wetting agents which are not of the fluorocarbon type may be mentioned the condensation products of octyl phenol and ethylene oxide (known under the trade name "Triton X-100" and marketed by Rohm & Haas), of nonyl phenol and ethylene oxide (marketed by Servo and Akzo Chemie N.V. under the trade names NOP 9 and Kyolox NO 90, respectively), and of lauryl alcohol and ethylene oxide.

It has been found that particularly the type of cationic surface active fluorocarbon compound is of great influence on the thickness of the porous layer.

The structural relationship between the surface active compound and the particles to be wetted with it is of great importance to obtain a high adsorption of the surface active compound on the particles.

Particularly favourable results are obtained if for the cationic surface active compound a compound with an acid proton is used. Especially the use of a compound with an $$-SO_2-\underset{\underset{H}{|}}{N}-$$

group is found to be very advantageous.

As example of such a compound may be mentioned the compound $C_8F_{17}SO_2N^H-(CH_2)_3-N^{\oplus}\equiv(CH_3)_3I^{\ominus}$ marketed by Minnesota Mining & Manufacturing Company under the trade name FC 134. For the anion it is generally preferred that instead of the $I^{\ominus}$-ion those anions should be used of which it is known that they cannot impair the quality of the bath. As examples of such anions may be mentioned $Cl^-$, $SO_4^{2-}$ or $CH_3SO_4^-$ Another suitable, commercially available surface active cationic fluorocarbon compound having a proton which can splitt off in an aqueous medium is:

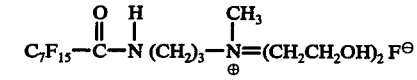

marketed by Hoechst under the trade name Hoechst S 1872.

Not only the type of wetting agents but also the particle size is of great influence on the thickness of the porous layer in the first electrolysis bath. When use was made of a PTFE concentration of about 40 g/l and a suitable combination of wetting agent, the resulting thickness of the porous layer was about 40 μm (13.2 g/m²) which was the same as that of the underlying composite layer. The use of a very fine resin dispersion generally yields a relatively thick porous layer.

It is an object of this invention to provide also a process for applying to an electrically conductive substrate a coating containing a polyfluorocarbon resin and, if desired particles of a different material. This process is characterized in that from an electroplating bath there is first co-deposited a metal and resin particles of a polyfluorocarbon having an average particle size of less than about 10 μm in a concentration of about 3 to 150 grammes per liter of bath solution in the presence of a cationic and nonionic surface active fluorocarbon compound in a molar ratio between 25:1 and 1:3.5 and in an amount which is at least $3 \times 10^{-3}$ mmoles per m² of the surface area of the polyfluorocarbon particles, and the resulting coating is subjected to a sintering treatment after impregnation or not with a suspension of particles of a different material.

It is preferred that the average particle size should not exceed 10 μm. In a variant of the process according to the invention a metal salt is incorporated in the coating under such conditions that the metal salt hydrolysis in the pores of the coating. The invention further relates to plated products which are entirely or partially provided with a coating applied by a process according to the invention. The plating solutions of the present invention are metal plating baths which contain an aqueous solution of a metal or metals to be electroplated, and a dispersion of fine fluorocarbon resin particles having an average size of less than about 10 μm in a concentration of about 3 to 150 grammes per liter of bath liquid, and a cationic and a nonionic surface active fluorocarbon compound in a molar ratio between 25:1 and 1:3.5 and in an amount which is at least $3.10^{-3}$ mmoles per m² of surface area of the polyfluorocarbon particles.

The invention will be further described in the following examples, which set forth embodiments of the invention for purposes of illustration and not limitation.

In the examples use is made of two types of polytetrafluoroethylene powders, which are marketed by ICI under the trade names FLUON L 169 and FLUON L 170. Moreover, use is made of a tetrafluoroethylene hexafluoropropylene copolymer dispersion in water, which is marketed by Du Pont under the trade name FEP 120. Fluon L 170 is brittle and is mainly present in the form of agglomerates. The particle size distribution is dependent on the dispersing method used.

For instance by making use of a sedimentation analysis technique described by H. E. Rose in "the Measurement of Particle Size in very fine Powders", London (1953), it can be determined what percentage of particles is still present in the form of agglomerates. It should be noted that the particle size distribution is also influenced by the amount of electrolyte contained in the bath liquid.

The measurements were all carried out in solutions which contained 2% by weight of particles.

In the preparation of the PTFE dispersion 1 part by volume of PTFE in two parts of water was stirred for 20 minutes with a high speed turrax stirrer. The speed of the turrax stirrer was 10,000 revolutions per minute. In the preparation of larger amounts of PTFE dispersion (some kilogrammes of PTFE) use was made of a Silverson stirrer of the TEFG type (1.0 h.p.) having a speed of 3,000 r.p.m.

For the suspensions prepared under these conditions the specific surface area determined by the nitrogen adsorption method in conformity with DIN 66132 was found to be in very good agreement with the specific surface area calculated from the particle size measured with a sedimentation analysis.

At a measured mean diameter of about 0.3 μm the specific surface area was found to be 9 m²/g (Fluon L 170), whereas at a measured mean diameter of ≧ 5 μm (Fluon L 169), the specific surface area was found to be < 0.5 m²/g.

The following table shows that these values are in good agreement with those calculated, it being assumed that the PTFE consists of non-porous spheres.

| particle diameter in μm | surface area in m²/g calculated |
|---|---|
| 0.1 | 28.6 |
| 0.2 | 14.3 |
| 0.3 | 9.5 |
| 0.5 | 5.3 |
| 1.0 | 2.9 |
| 2.0 | 1.4 |
| 3.0 | 1.0 |
| 5.0 | 0.5 |
| 10.0 | 0.3 |

In the examples mainly use is made of the above mentioned fluorocarbon surfactants FC 134 and FC 170, which are marketed by Minnesota Mining & Manufacturing Company.

In the conversion of the amounts by weight used into the amounts of moles it was assumed that the degree of purity of the above surfactants was about 85 percent and 70 percent by weight, respectively.

EXAMPLE I (FOR COMPARISON)

An electroplating bath was prepared employing the following composition ingredients:

| substance | g/l |
|---|---|
| $NiSO_4 . 6H_2O$ | 190 |
| $NiCl_2 . 6H_2O$ | 90 |
| $H_3BO_3$ | 30 |

The nickel electrodes in the bath were in the form of plates. With a high-speed turrax stirrer 100 g of PTFE (Fluon L 170) were stirred for 20 minutes in 100 ml of water to which 4 g (6.5 mmoles) of a cationic wetting agent (FC 134) had been added. The contents were subsequently transferred to a 5 l - Watt's nickel bath of the above composition, which had to be continuously agitated to prevent the PTFE from depositing.

The duration of the electrolysis was about 1 hour at 40° C. and the current density was 2 A/dm².

FIG. 1 is a photomicrograph of a cross-section (× 800) of the coating obtained. This coating contained 16 percent by volume of PTFE.

After the sample had been taken out of the bath no adhering porous layer was found to have formed on it.

EXAMPLE II

The experiment of example I was repeated in such a way that in the preparation of the PTFE suspension also 1 g (1.35 mmoles) of a nonionic surface active fluorocarbon compound (FC 170) was used (about 17 mole percent nonionic). Stirring the bath to prevent the dispersion from depositing appeared to be quite unnecessary. After the sample had been taken out of the bath it was found that then had formed a first layer of a mixture of Ni and PTFE with on it a second layer exclusively consisting of PTFE. Said second layer was not found to have formed in Example I It could easily be removed by rubbing with a cloth.

Figure 2:
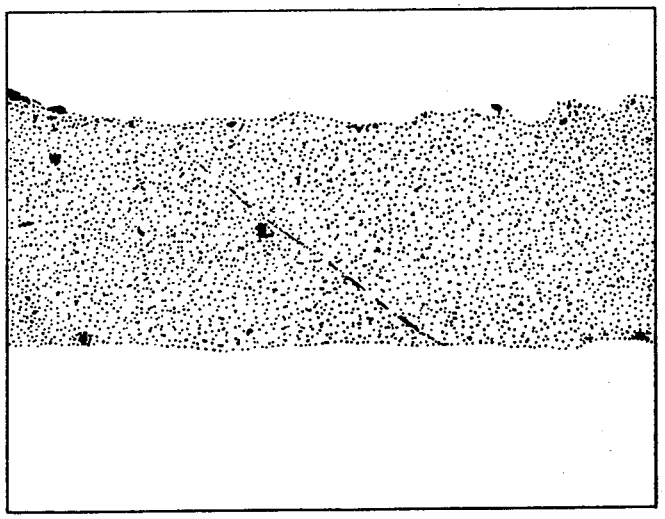

The structure of the first composite layer obtained was found to be quite different from that of the coating prepared in Example I. FIG. 2 is a photomicrograph (× 800) of the coating obtained. In this case the coating contained PTFE in an amount of 28 percent by volume.

EXAMPLE III

The procedure used in Example II was repeated in such a way that the nonionic surface active fluorocarbon compound was employed in an amount of only 450 mg (0.6 mmoles) (about 10 mole percent nonionic).

The resulting dispersion was remarkably stable and the appearance of the coating obtained most clearly resembled that of the structure given in FIG. 2.

EXAMPLE IV

The experiment of Example II was repeated in such a way that for the preparation of the PTFE dispersion only 250 mg (0.34 mmoles) of FC 170 and 4750 mg (7.7 mmoles) of FC 134 were employed (molar ratio cationic wetting agent to nonionic wetting agent 23:1).

The stability of the dispersion thus prepared was considerably lower than that of the dispersion in Example III.

The quality of the coating, however, was still appreciably better than that of the coating in Example I. The structure of the coating came nearest to that of FIG. 2.

EXAMPLE V

The experiment of Example II was repeated in such a way that for the preparation of the dispersion 4 g (5.4 mmoles) of FC 170 and 1 g (1.6 mmoles) of FC 134 were used (molar ratio cationic to nonionic wetting agent 1:3.4) The resulting dispersion was stable but showed a tendency to agglomerate after one night's standing. Moreover, the nickel coating obtained was somewhat brittler than when a lower percentage of FC 170 was used.

EXAMPLE VI

An electroplating bath was used with nickel electrodes in the form of plates and with the following ingredients:

| substance | g/l |
|---|---|
| $NiSO_4 . 6H_2O$ | 190 |
| $NiCl_2 . 6H_2O$ | 90 |

-continued

| substance | g/l |
|---|---|
| $H_3BO_3$ | 30 |

In the bath there were dispersed 50 g of PTFE (Fluon L 169 B) which had been wetted with 350 mg of FC 134 and 150 mg of FC 170 (about 26 mole percent nonionic). The amount of PTFE incorporated after 1 hour at 50° C. and a current density of 2 A/dm$^2$ was 13% by volume. When under the same conditions there were used 50 g of PTFE of the Fluon type L 170 that had been wetted with 1.75 g of FC 134 and 0.75 g of FC 170, the coating was found to contain 33% by volume.

EXAMPLE VII

In this example it is shown that the amount in which PTFE is contained in the bath very much influences the percentage by volume of PTFE incorporated into the metal coating.

In all cases the temperature of the bath was 55° C, the current density 2 A/dm$^2$ and the duration of the electrolysis 1 hour.

The composition of the bath corresponded to that given in Example I.

The amounts of Fluon L 170 wetted with 40 mg of FC 134 per gramme and 10 mg of FC 170 per gramme are given in the following table. Beside them are given the amounts of PTFE (in percent by volume) incorporated into the metal coatings.

| Amount of Fluon L 170 (in g/l) | volume percentage |
|---|---|
| 20 | 28 |
| 30 | 38 |
| 50 | 45 |
| 80 | 52 |

EXAMPLE VIII

In this example it is shown that while use is made of the same amount of FC 134 per gramme of PTFE the presence of only a small amount of a nonionic wetting agent may cause the volume percentage of PTFE in the coating to increase by a factor of almost 3. The electrolysis conditions were the same as those given in Example II. In all cases the bath contained 50 g of PTFE per liter. As nonionic wetting agent both a fluorocarbon compound and a non-fluorocarbon compound were employed. The results are given below.

Polyfluorocarbon: Fluon L 170 cationic fluorocarbon compound: FC 134 (40 mg/g PTFE)

| nonionic wetting agent | volume percentage | coating appearance |
|---|---|---|
| none | 16 | irregular with cracks |
| FC 170 (10 mg/g PTFE) | 45 | porefree |
| NOP 9 (10 mg/g PTFE) | 25 | few pores or cracks |

From the results of the above-mentioned experiments it is clear that the use of a nonionic wetting agent will under otherwise equal conditions cause the proportion of PTFE incorporated to increase strongly or very strongly. Only upon using a nonionic fluorocarbon compound is the distribution of the PTFE in the metal coating found to be such as to be suitable for most applications.

EXAMPLE IX

An electroplating bath with copper electrodes in the form of plates and having the following composition:

| substance | g/l |
|---|---|
| CU $SO_4 . 5 H_2O$ | 200 |
| $H_2SO_4$ 96% | 80 |
| PTFE (Fluon L 170) | 20 |
| FC 134 (with as anion $SO_4^{2-}$) | 0.8 |
| FC 170 | 0.4 |

After 1 hour electrolysis at a current density of 2 A/dm² at 20° C. there was obtained a pore-free metal coating of 25 μm containing 30 percent by volume of PTFE.

Noteworthy about this coating was that it was free of stress.

EXAMPLE X

The procedure of Example IX was repeated but in such a way that zinc was used instead of copper.

The composition of the plating bath was as follows:

| substance | g/l |
|---|---|
| $ZnSO_4$ | 350 |
| $(NH_4)_2SO_4$ | 30 |
| PTFE (Fluon L 170) | 50 |
| FC 134 | 1.75 |
| FC 170 | 0.75 |

After 1 hour's electrolysis at a current density of 3 A/dm² and a temperature of 20° C. the metal coating was found to contain 39 percent by volume of PTFE.

The use of Fluon L 169, which had been wetted with 350 mg FC 134 and 150 mg of FC 170, led under otherwise equal conditions to obtaining a metal coating containing 9 percent by volume of PTFE.

EXAMPLE XI

A Watt's nickelplating bath was prepared employing the following composition ingredients:

| | g/l |
|---|---|
| $NiSO_4 . 6 H_2O$ | 215 |
| $NiCl_2 . 6 H_2O$ | 70 |
| $H_3BO_3$ | 30 |
| PTFE (Fluon L 170) | 40 |
| FC 134 | 1.6 (2.6 mmoles) |
| FC 170 | 0.4 (0.54 mmoles |

The pH of the bath was 4.5 The anode was a plate-shaped nickel electrode and the cathode was formed by a stainless steel tube. This tube had first been cleaned by blasting and degreasing and subsequently activated in a 20% - sulphuric acid solution. Stirring the bath to prevent precipitation appeared to be quite unnecessary. On the tube two layers had formed. The first layer consisted of a mixture of Ni and PTFE with on it a second layer exclusively of PTFE. The percentage by volume of PTFE incorporated in the first layer was 30%. The PTFE had bonded as a porous layer in an amount of 13.2 g/m². The thicknesses of the composite coating and the porous coating bonded to it were 24 μm and 40 μm, respectively.

The tube was subsequently transferred to a nickel sulphamate bath of the following composition:

| | g/l |
|---|---|
| Ni $(NH_2SO_3)_2$ | 465 |
| $H_3BO_3$ | 45 |
| $NiCl_2 . 6 H_2O$ | 5 |

The pH of the bath was 4. After some time (about 1 hour) the porous layer was found to be entirely filled up with nickel. The current density in the second bath was 2 A/dm². Upon analysis the second nickel coating was found to contain about 30% by volume of PTFE.

EXAMPLE XII

The procedure of Example XI was repeated. Instead of the fluorine-containing wetting agent (FC 134), however, a practically identical wetting agent was used. But the $—SO_2—N^H—$ group in it had been replaced with an $$—\overset{\overset{\displaystyle O}{\|}}{C}—N^H—\text{group}$$

Again two layers were formed. PTFE was incorporated in the first layer in an amount of 25% by volume. The amount of bonded PTFE was 9.6 g/m². It is clear that the use under the same process conditions of a cationic wetting agent with a less acid proton leads to a less thick porous layer.

EXAMPLE XIII

The experiment of Example XI was repeated, but in such a way that use was made of a wetting agent without acid proton and having the following structural formula:

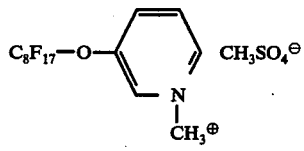

Again two layers were formed. The percentage by volume of PTFE incorporated in the first layer was 19%. In this case the amount of bonded PTFE was as little as 1.0 g/m². In comparison with the results obtained in the Examples XI and XII it is very clear that the presence of an acid proton is of great influence on the ratio of the thickness of the composite layer to that of the porous layer.

EXAMPLE XIV

The experiment of Example XI was repeated in such a way that instead of PTFE use was made of an anionic dispersion of tetrafluoroethylene-hexafluoropropylene (FEP). After it had been centrifuged, it was washed with methanol and subsequently treated with the fluorine - containing wetting agents FC 134 and FC 170.

At a concentration of 17 g FEP/l and a current density of 3 A/dm² the amount of FEP contained in the first composite layer was found to be 14% by volume. The amount of bonded FEP was 21 g/m². The coating was subjected to an after-sintering treatment at 350° C. A homogeneous, continuous corrosion-resistant coating of FEP was formed.

EXAMPLE XV

A zinc bath of the following composition was prepared:

| | g/l |
|---|---|
| $ZnSO_4 . 7 H_2O$ | 110 |
| $H_3BO_3$ | 5 |
| $ZnCl_2$ | 20 |
| PTFE | 40 |
| piperonal | 1 |
| FC 134 | 1.4 (2.3 mmoles) |
| FC 170 | 0.6 (0.8 mmoles) |

The pH of the bath was between 4 and 5. The anode was a plate-shaped zinc electrode and the cathode was formed by a stainless steel tube. After the same pretreatment as in Example XI an electrolysis was carried out for 1 hour at a current density of 2.5 A/dm$^2$. Again two layers were formed. The first consisted of a mixture of Zn and PTFE with a second layer on it exclusively of PTFE. The first layer was found to contain 35% by volume of PTFE. The amount of bonded PTFE was 24 g/m$^2$.

EXAMPLE XVI

A stainless steel tube was treated in a Watt's nickel bath in the same way as indicated in Example XI. After a porous layer of PTFE (13.2 g/m$^2$) had formed on the composite nickel-teflon coating, the tube was rinsed in water and transferred to a second bath whose anode consisted of a paper plate. The tube was connected to the negative pole. The composition of the bath was as follows:

| | g/l |
|---|---|
| $Cu SO_4 . 7 H_2O$ | 200 |
| Na Cl | 0.1 |
| $H_2SO_4$ (96%) | 150 |

The electrolysis lasted 1 hour, at a temperature of 20° C. and a current density of 2 A/dm$^2$. Upon analysis the copper coating applied was found to contain about 20% by volume of PTFE.

Figure 3:
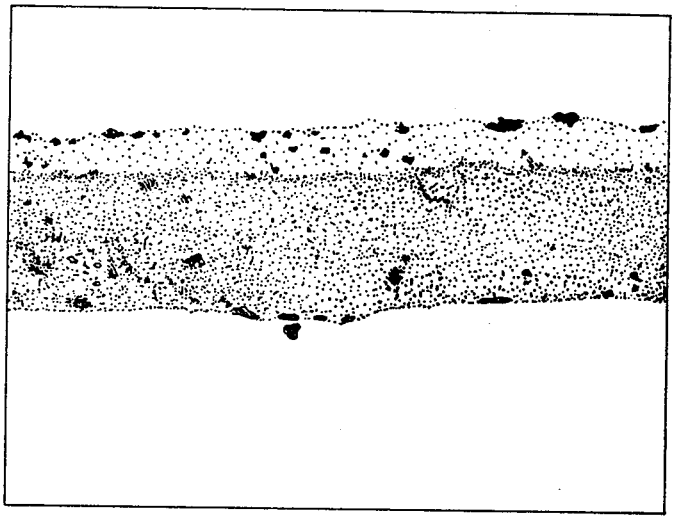

FIG. 3 is a photomicrograph of the coating obtained.

EXAMPLE XVII

A stainless steel tube was treated in a Watt's nickel-plating bath in the same way as indicated in Example XI. After a porous layer of PTFE (13.2 g/m$^2$) had formed on the composite nickel-PTFE coating, the tube was rinsed with water and transferred to a second bath whose anode consisted of a lead plate.

The cathode was formed by the tube. The composition of the bath was as follows:

| | g/l |
|---|---|
| $Pb (BF_4)_2$ | 275 |
| HBF (free) | 40 |
| $H_3BO_3$ | 20 |

Figure 4:
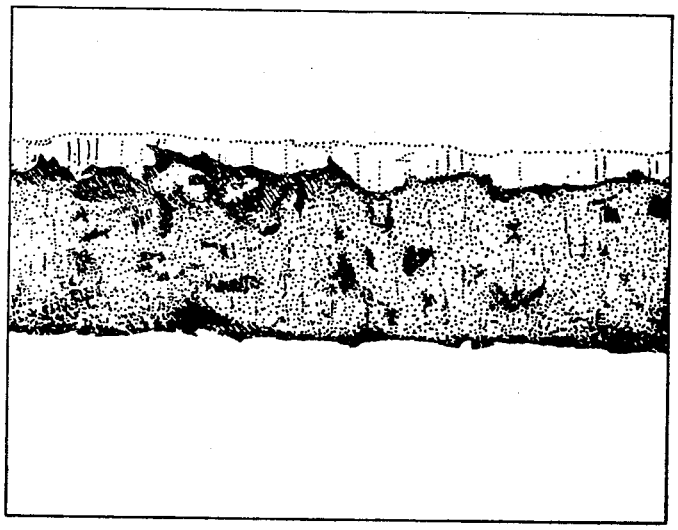

Current was passed through for 1 hour at a temperature of 30° C. and a current density of 2 A/dm$^2$. The pH of the bath was between 0.5 and 1. Upon analysis the lead coating applied to the tube was found to contain 16% by volume of PTFE. FIG. 4 is a photomicrograph of the coating obtained.

EXAMPLE XVIII

A stainless steal tube was treated in a Watt's nickel-plating bath in the same way as indicated in Example XI. After a porous layer (13.2 g/m$^2$) had formed on the composite nickel-PTFE coating, the tube was rinsed with water and transferred to a second bath whose anode was formed by a cobalt bar. The cathode was formed by the tube. The composition of the bath was as follows:

| | g/l |
|---|---|
| $CoSO_4 . 7 H_2O$ | 300 |
| $CoCl_2 . 6 H_2O$ | 30 |
| $H_3BO_3$ | 30 |

Current was passed through for 1 hour at a temperature of 50° C. and a current density of 4 A/dm$^2$. The pH of the bath was between 4 and 4.5. Upon analysis the cobalt coating applied to the tube was found to contain about 28% by volume of PTFE.

Instead of a composite nickel-PTFE coating a composite cobalt PTFE coating may be used, which may be obtained for instance under the following conditions:

| | g/l |
|---|---|
| $CoSO_4 . 6 H_2O$ | 300 |
| $CoCl_2$ | 50 |
| $H_3BO_3$ | 30 |
| PTFE type L 170 | 50 |

The pH of the bath was 4. The temperature was 50° C. Wetting agents: FC 134/FC 170 with 35 and 15 mg/g PTFE, respectively.

EXAMPLE XIX

In this example it is shown that instead of the simple cationic surface active compounds of the fluorocarbon type employed in the preceding examples use may be made according to the invention of surfactants of the fluorocarbon type obtained by reversing the polarity of an anionic fluorocarbon surfactant.

Two Watt's nickel plating baths were prepared having the following composition:

| | g/l |
|---|---|
| $NiSO_4 . 6 H_2O$ | 240 |
| $NiCl_2 . 6 H_2O$ | 60 |
| $H_3BO_3$ | 30 |
| pH | 4.7 |
| temperature | 40° C |

In both baths the anode was a plate-straped nickel electrode and the cathode was formed by a stainless steel tube.

Both baths contained a positively charged PTFE dispersion (about 50 g/l). (Fluon L 170) In both cases the positively charged dispersion was obtained by reversing the polarity of a 50 g per liter PTFE - containing dispersion wetted with an anionic fluorocarbon surfactant (6 g of a 30% - solution), marketed by ICI under the trade name Monflor 31.

The structure of Monflor 31 corresponds to the following formula:

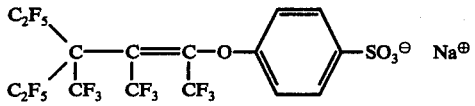

For reversing the polarity use was made of an aqueous solution containing 6 g/l of a cationic surfactant having the following formula:

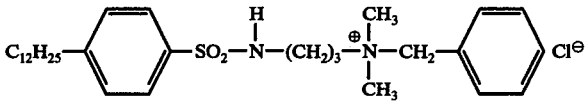

The molar ratio of the cationic surfactant to the anionic surfactant was about 4.

After the dispersion thus prepared had been transferred to a Watt's nickel plating bath of the above mentioned composition the bath had to be continuously agitated to prevent the PTFE from settling.

The above specified surface area of Fluon L 170 being 9 $m^2/g$, the anionic fluorocarbon surfactant was present in an amount of $5.9 \times 10^{-3}$ mmoles/$m^2$.

Taking into account the above definition of cationic fluorocarbon surfactants, it may be stated that after reversing their polarity they were also present in an amount of $5.9 \times 10^{-3}$ mmoles/$m^2$.

The electrolysis was carried out over a period of 1 hour at a current density of 2 A/$dm^2$ and at a temperature of 45° C.

The structure of the resulting coating showed a close resemblance to that of FIG. 1 (Example I).

The experiment was repeated using a second PTFE dispersion (Fluon L 170) whose polarity was reversed in the same manner.

To this dispersion, however, there had been added 750 mg of the above mentioned nonionic fluorocarbon surfactant FC 170 per 50 g of PTFE. This corresponds to an amount of about 2.2 mmoles/$m^2$. So the molar percentage of the nonionic fluorocarbon surfactant was about 27 percent of the total molar amount of fluorocarbon surfactants present.

Stirring the bath to prevent precipitation was found to be quite unnecessary. The coating obtained showed a structure which closely resembled that of FIG. 2 (Example II).

EXAMPLE XX.

100 ml of aqueous tetrafluoroethylene - hexafluoropropylene copolymer dispersion marketed by Du Pont under the trade name FEP 120 was centrifuged at 6000 r.p.m for 30 minutes.

The supernatant layer of clear liquid was decanted. In a porcelain dish the FEP was extracted with 200 ml of boiling methanol for about half an hour. After the methanol had been decanted the powder obtained was dried overnight at 40° C.

With the aid of an ultra turrax stirrer 42 g of FEP powder were dispersed in water with 35 mg of FC 134 and 15 mg of FC 170 per gramme of FEP. The specific surface area of the FEP was about 9 $m^2/g$.

Upon mixing with 2 l of Watt's nickel bath the dispersion remained stable. After the bath had been evaporated to its original concentration, it was used for 15 Ah/l, during which time the pH remained at 4.8.

After another 16 Ah/l passage of current (2 A/$dm^2$) the bath still contained 17.2 g FEP/l; the pH had decreased to 4.5.

In this electrolyte a stainless steel tube was nickel-plated. Conditions: current density 3 A/$dm^2$; temperature 40° C; FEP-content 17.2 g/l; time: 1 hour.

The result was a satisfactorily codeposited Ni-FEP-coating, which contained 14 volume percent of FEP. Also a thick porous layer had formed (21 g/$m^2$).

What is claimed is:

1. In a process for applying to an electrically conductive substrate acting as a cathode a composite coating made up of a polyfluorocarbon resin and a metal, wherein the resinous particles have an average particle size of less than about 10 μm and are kept dispersed in a concentration of about 3 to 150 grammes per liter of bath solution in the presence of a cationic fluorocarbon surfactant and a nonionic surfactant, the improvement comprising:
   a. using for the nonionic surface active compound a fluorocarbon compound;
   b. maintaining the molar ratio between the cationic surface active compound and the nonionic surface active fluorocarbon compound between 25:1 and 1:3.5; and
   c. maintaining the total amount of surface active fluorocarbon compounds above $3 \times 10^{-3}$ mmoles per $m^2$ of surface area of the polyfluorocarbon particles.

2. The process of claim 1 wherein the surface active fluorocarbon compounds are present in an amount of $6.10^{-3}$ to $12.10^{-3}$ mmoles per $m^2$ of the surface area of the resin particles.

3. The process of claim 1 wherein the nonionic surface active fluorocarbon compound is present in an amount of about 17 to 36 mole percent of the total amount of surface active fluorocarbon compounds used for the dispersion of the resin particles.

4. The process of claim 1, wherein the nonionic fluorocarbon compound is present in an amount of about 26 mole percent of the total amount of surface active fluorocarbon compounds used for the dispersion of the resin particles.

5. The process of claim 1 wherein said nonionic fluorocarbon compound is a wetting agent which satisfies the following structural formula:

$$C_8F_{17}SO_2-\overset{\overset{\displaystyle C_2H_5}{|}}{N}-(CH_2CH_2O)_{11-14}-H,$$

where $C_8F_{17}$ represents a straight-chain fluorocarbon.

6. The process of claim 1 in which to an electrically conductive substrate there is applied a composite coating made up of a polyfluorocarbon resin, a metal and, if desired particles of a different material, the improvement comprising in that on to the resulting coating serving as cathode there is subsequently deposited from an electroplating bath of a different composition a metal and, if desired, particles of a different material.

7. The process of claim 6 wherein said cationic surface active fluorocarbon compound is a compound with an acid proton.

8. The process of claim 6 wherein said cationic fluorocarbon-containing wetting agent is a compound with an $$-SO_2-\underset{H}{N}-\text{ group.}$$

9. The process of claim 6 wherein said cationic fluorocarbon-containing wetting agent is a compound having the formula:

$$C_8H_{17}SO_2-\overset{H}{\overset{|}{N}}-(CH_2)_3\overset{\oplus}{N}(CH_3)_3 \qquad X^{\ominus}\text{, where X}$$

represents an anion which does not interfere with the electrolysis, such as $SO_4^{2-}$, $Cl^-$ or $CH_3SO_4^{\ominus}$ 10. The process of claim 1 wherein the coating thus obtained is subjected to a sintering treatment after impregnation or not with a dispersion of particles of a different material.

11. The process of claim 10 wherein the average particle size of the particles of said different material in the dispersion is not more than 10 μm.

12. The process of claim 10 wherein for said different material use is made of a metal salt which hydrolyses in the pores of the coating.

13. The product of the process of claim 1.

14. The process of claim 1, wherein the coating also contains particles of a different material.

15. A metal plating bath, comprising an aqueous solution of a metal or metals to be electroplated and containing dispersed therein fine fluorocarbon resin particles having an average size less than about 10 μm in a concentration of about 3 to 150 grammes per liter of bath liquid, and having dissolved in said plating bath a cationic and a nonionic surface active fluorocarbon compound, in a molar ratio between 25:1 and 1:3.5 and in an amount which is at least $3.10^{-3}$ mmoles per $m^2$ of surface area of the polyfluorocarbon particles.

16. A metal plating bath according to claim 15 wherein the total amount of fluorocarbon surfactants is between about $6.10^{-3}$ and $12.10^{-3}$ mmoles per $m^2$ of surface area of the polyfluorocarbon particles.

17. A metal plating bath according to claim 15 wherein the nonionic fluorocarbon surfactant is present in an amount of about 17 to 36 mole percent of the total amount of fluorocarbon surfactants used for the dispersion of the resin particles.

18. A metal plating bath according to claim 15 wherein the nonionic fluorocarbon surfactant is present in an amount of about 26 mole percent calculated on the total amount of fluorocarbon surfactants in said bath.

19. A metal plating bath according to claim 15 wherein said nonionic fluorocarbon surfactant is a compound having the formula:

$$C_8F_{17}SO_2-\overset{C_2H_5}{\overset{|}{N}}-(CH_2CH_2O)_{11-14}H$$

* * * * *

UNITED STATES PATENT AND TRADEMARK OFFICE

CERTIFICATE OF CORRECTION

PATENT NO. : 4,098,654

DATED : July 4, 1978

INVENTOR(S) : Kees HELLE, Robert Cornelis GROOT and Andries KAMP

It is certified that error appears in the above-identified patent and that said Letters Patent are hereby corrected as shown below:

IN THE ABSTRACT, lines 1-2, "codeposition" should read -- codeposited --.

Column 2, line 3, "ml" should read -- $m^2$ --.

Column 21, line 10, the formula should read -- $C_8F_{17}$ -- instead of "$C_8H_{17}$".

Signed and Sealed this

Sixth Day of March 1979

[SEAL]

*Attest:*

RUTH C. MASON
*Attesting Officer*

DONALD W. BANNER
*Commissioner of Patents and Trademarks*